United States Patent [19]

Adams

[11] 4,244,499

[45] Jan. 13, 1981

[54] FOLDABLE PACK BELT

[75] Inventor: Brian J. Adams, Bristol, Va.

[73] Assignee: Evrika Pack Corp., Lexington, Va.

[21] Appl. No.: 38,945

[22] Filed: May 14, 1979

[51] Int. Cl.[3] ..... B65D 30/10; B65D 33/24

[52] U.S. Cl. ..... 224/224; 224/228; 224/222; 150/7

[58] Field of Search ..... 224/222, 224, 195, 219, 224/228, 229, 267; 150/7

[56] References Cited

U.S. PATENT DOCUMENTS

| | | | |
|---|---|---|---|
| 926,402 | 6/1909 | Geissler | 224/222 |
| 1,478,497 | 12/1923 | Welch | 224/224 |
| 2,298,600 | 10/1942 | Stember | 224/228 X |
| 2,383,748 | 8/1945 | Sherman | 224/228 X |
| 3,374,636 | 3/1968 | Mason | 224/224 X |
| 3,525,376 | 8/1970 | Muhlhauser | 150/52 |
| 3,557,853 | 1/1971 | Jones | 150/7 |
| 3,963,199 | 6/1976 | Pravaz | 244/148 |
| 4,029,243 | 6/1977 | Zerobnick et al. | 244/8 R |
| 4,079,871 | 3/1978 | Sica | 244/5 D |
| 4,139,130 | 2/1979 | Glusker et al. | 244/54 W |
| 4,139,133 | 2/1979 | Repka | 244/26 C |

*Primary Examiner*—Steven M. Pollard

*Attorney, Agent, or Firm*—Fleit & Jacobson

[57] ABSTRACT

A foldable pack belt for carrying at least one article. The pack belt is formed by folding longitudinally-extending edges of a planar member about an article or articles placed on an inner surface of the member. Complementary fastening mechanisms are associated with the longitudinally-extending edges to releasably and adjustably hold the planar member in a rolled condition. Subsequently, transversely-extending edges of the planar member are folded towards each other and releasably and adjustably interconnected to each other by components of a second complementary fastening mechanism to form the pack. The components of the fastening mechanisms are adjustable with respect to each other so that the size of the pack can be varied to accommodate the size of articles to be carried.

21 Claims, 14 Drawing Figures

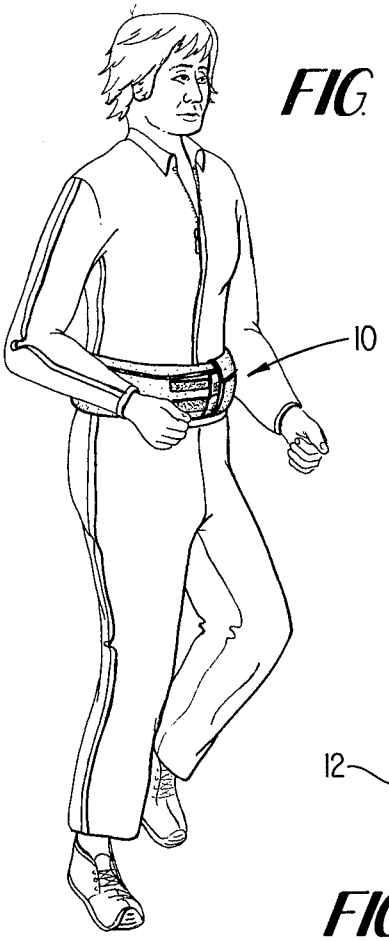
FIG. 1
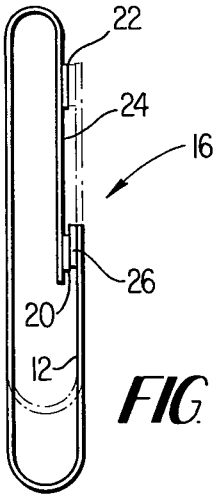
FIG. 8
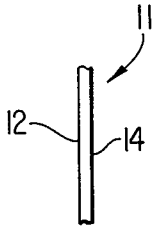
FIG. 5
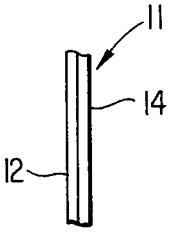
FIG. 6
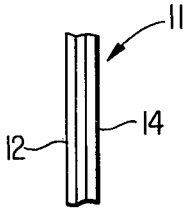
FIG. 7
FIG. 2
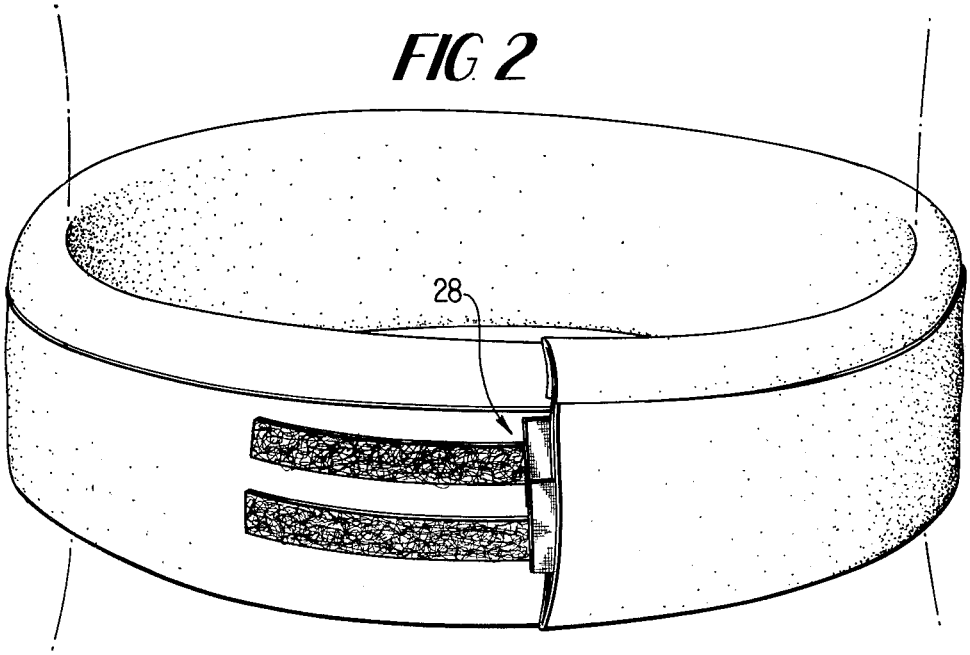

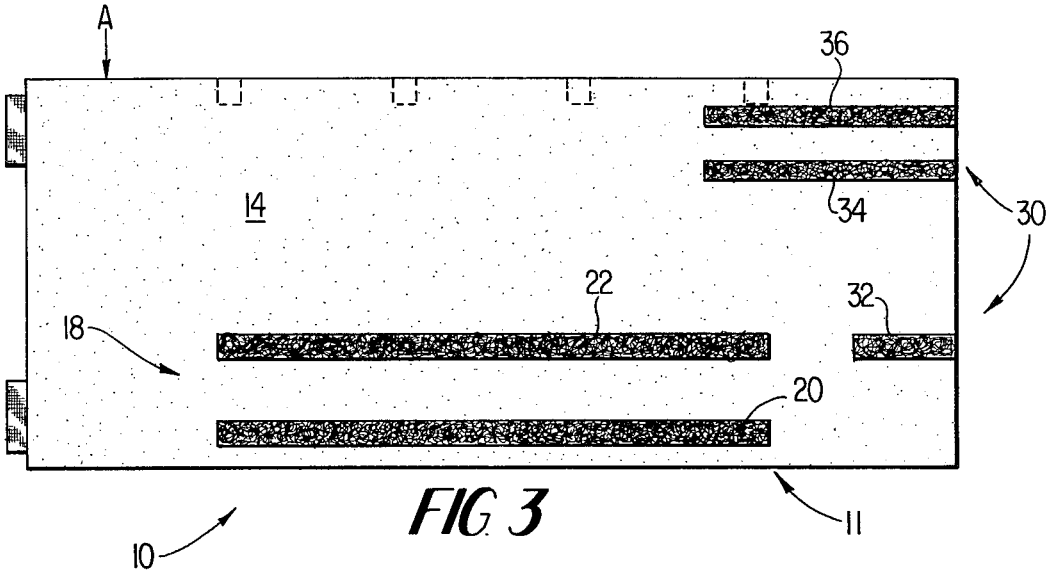
FIG. 3
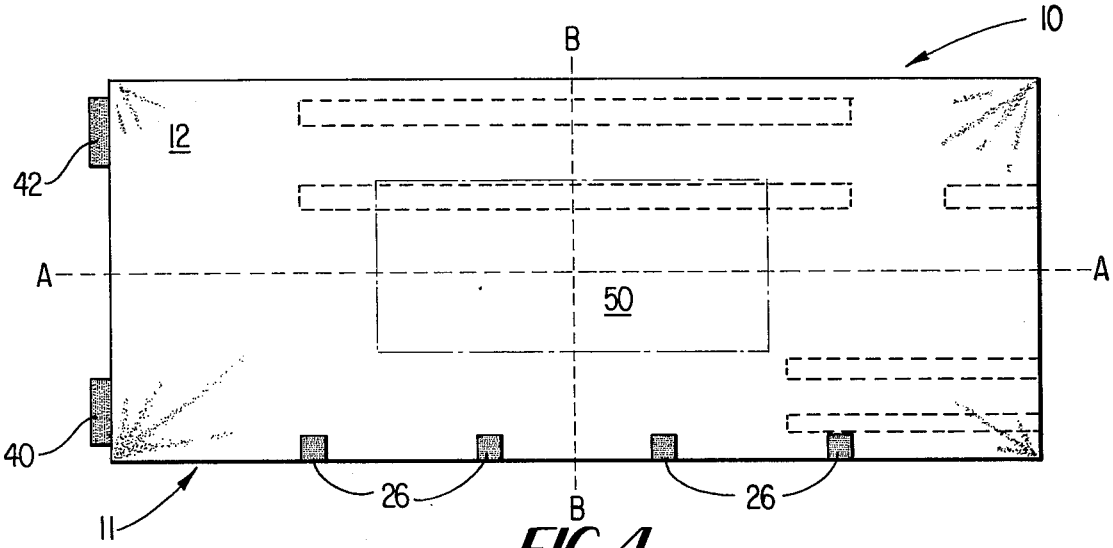
FIG. 4
FIG. 9
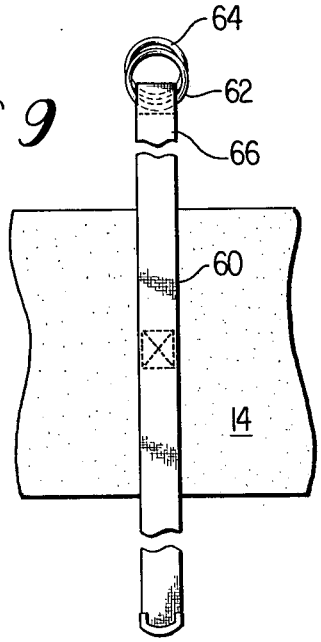
FIG. 10
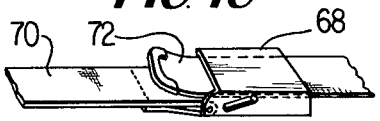
FIG. 11
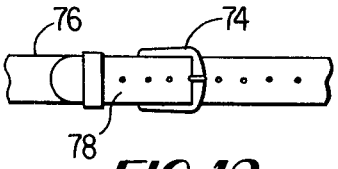
FIG. 12
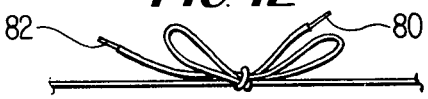

FOLDABLE PACK BELT

BACKGROUND OF THE INVENTION

1. Field of the Invention

This invention relates to a foldable container or backpack for carrying equipment and supplies. More particularly, this invention relates to a belt-supported pack of unitary construction that is worn around a person's waist for carrying equipment and supplies used for jogging, hiking, climbing, and other related outdoor activities.

2. Description of the Prior Art

Known in the prior art are complementary fastening mechanisms that use synthetic materials having complementary surfaces which adhere to each other when pressed together and resist separation when a force is applied parallel to their adhering surfaces. A first of the complementary surfaces has a multiplicity of small filamentary members of a crinkle configuration forming "eyes" which cooperate with each other to define a mat surface. A second of the complementary or mating surfaces has a multiplicity of small loops made up of filamentary material forming "hooks" engagable with the "eyes" of the first surface. Hereinafter, the term "snag surface" or "snag" will be used to refer to the first surface and the term "hook surface" or "hook" will be used to refer to the second surface. Also, such fastening mechanism will be generally referred to as "snag and hook fasteners." One type of such snag and hook fastener is sold under the trademark VELCRO.

Numerous uses have been found for snag and hook fasteners. For instance, U.S. Pat. No. 3,525,376 describes the use of snag and hook fasteners to releasably hold articles in a receptacle and display packet. Further, U.S. Pat. No. 3,963,199 describes the use of snag and hook fasteners to form a closing device for a parachute pack. Another example of the use of such fasteners is described in U.S. Pat. No. 4,029,243 which describes the use of snag and hook fasteners with an integrated belt-supported backpack. Still further, U.S. Pat. No. 4,079,871 describes the use of snag and hook fasteners with a belt-type garment for carrying tennis balls and similar articles. It is also known to use such fasteners to form a "shoe" for covering a cast. The "shoe" is adjustable both lengthwise and widthwise.

SUMMARY OF THE INVENTION

In accordance with the present invention, a backpack, belt pack or foldable container is provided that is adjustable about both horizontal and vertical axes to exert biaxial forces on an article or articles positioned within the container.

The container utilizes a substantially planar, usually and generally rectangular-shaped carrying member that is folded or rolled about its longitudinal or horizontal axis to exert a first axial force on articles positioned within the carrying member. A first complementary fastening mechanism is provided to hold the carrying member in its rolled condition. Subsequently, the rolled member is folded about the waist of a user to exert a second axial force on articles positioned within the carrying member. A second set of complementary fasteners are connected to the ends of the carrying member to releasably secure the member about the waist of the user. Provision of the two sets of complementary fasteners enables subjecting carried articles to both horizontal and vertical forces so that the articles are securely held within the container in desired positions.

In a preferred embodiment of the present invention, the complementary fasteners are snag and hook type fasteners that are positioned on predetermined portions of the carrying member to allow the rolling of the member about its horizontal axis and the folding of the rolled member about its vertical axis. Preferably, the carrying member is formed of a porous material so that air is free to pass therethrough, thereby minimizing the discomfort of a wearer of the container. In one embodiment of the present invention, the carrying member is a two-ply member with one side being formed of chamois or similar smooth material, and one side formed of towelling material, such as terrycloth. The chamois surface is positioned against the body of the wearer to minimize frictional forces between the body and the container. The towelling is positioned inside the rolled container to absorb any moisture that might pass through the chamois. If desired, the articles positioned inside the container can be wrapped in plastic or similar impervious material to protect them from any moisture that might be absorbed by the towelling material.

The invention, and its objects and advantages, will become more apparent in the detailed description of the preferred embodiments.

BRIEF DESCRIPTION OF THE DRAWINGS

In the detailed description of the preferred embodiments presented below, reference is made to the accompanying drawings, in which:

FIG. 1 is an illustration of one embodiment of a container or belt of the present invention in use;

FIG. 2 is an enlarged perspective view of the embodiment illustrated in FIG. 1;

FIG. 3 is a schematic, disassembled view of the inner surface of the embodiment of FIG. 1;

FIG. 4 is a schematic view, similar to FIG. 3, of an outer surface of the embodiment of FIG. 1;

FIG. 5 is a schematic view taken in the direction of Arrow A, FIG. 3;

FIG. 6 is a schematic view, similar to FIG. 5, of another embodiment of the present invention;

FIG. 7 is a schematic view, similar to FIG. 5, of still another embodiment of the present invention;

FIG. 8 is an end view of the embodiment illustrated in FIG. 3 in a partially assembled position;

FIG. 9 is a partial schematic view, similar to FIG. 4, of another embodiment of the present invention;

FIG. 10 is a partial schematic view, similar to FIG. 9, of a portion of still another embodiment of the present invention;

FIG. 11 is a partial schematic view, similar to FIG. 11, of a portion of still another embodiment of the present invention;

FIG. 12 is a partial schematic view, similar to FIG. 9, of a portion of still another embodiment of the present invention;

DESCRIPTION OF THE PREFERRED EMBODIMENTS

Figure 13:
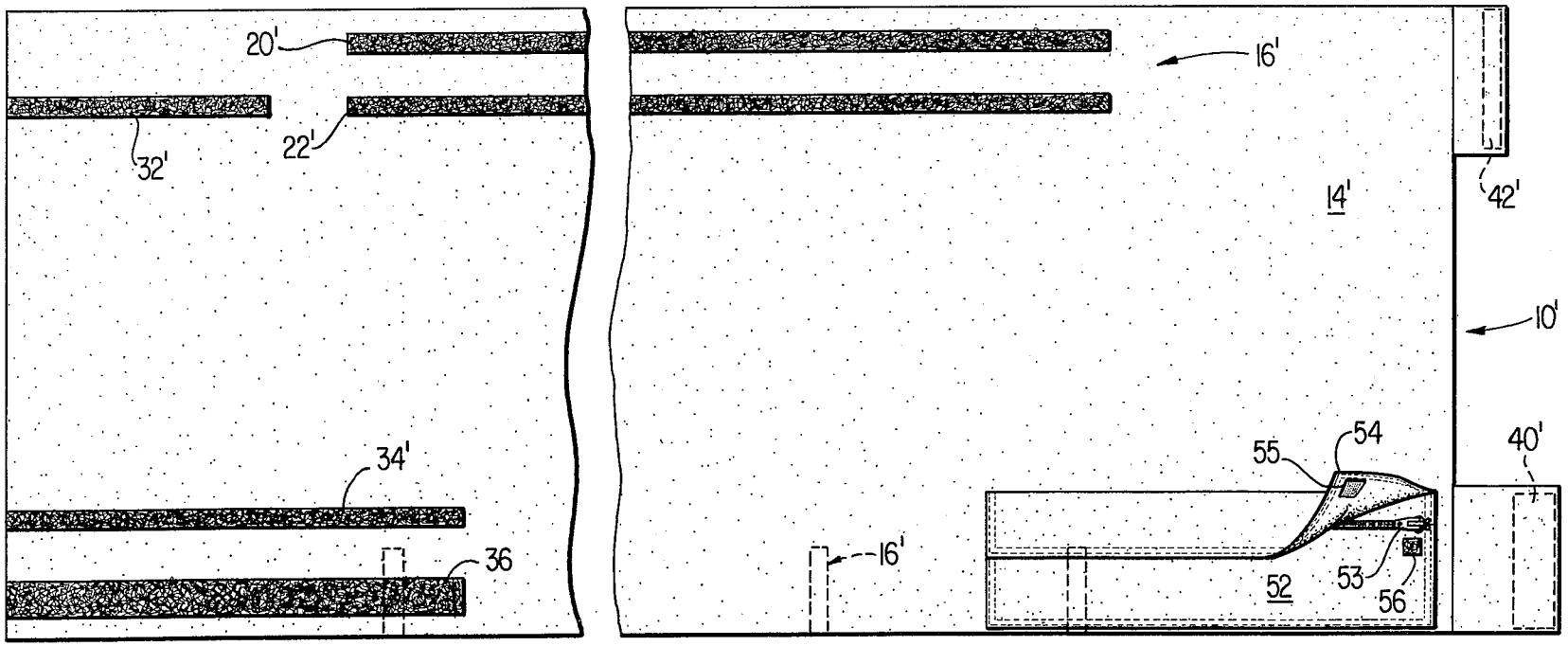
FIG. 13 is a view similar to FIG. 3 of a further embodiment of the present invention.

Because backpacks and similar containers for articles are well known, the present description will be directed in particular to elements forming part of, or cooperating more directly with, the present invention. Elements not specifically shown or described herein are understood to be selectable from those known in the art.

Referring now to the drawings, and to FIGS. 3 and 4 in particular, one embodiment of the present invention is illustrated and will be described in connection with a foldable container or pack belt, generally designated 10. The pack belt 10, in an unassembled or unfolded condition, has a substantially planar, preferably usually and generally rectangular-shaped carrying member, generally designated 11. The carrying member 11 has an inner surface or side 12, and an outer surface or side 14. As illustrated in FIG. 8, a first complementary fastening mechanism, generally designated 16, has a snag surface or component 18 positioned on the outer surface 14. As illustrated in FIG. 3, the snag component 18 has first and second horizontally-extending surfaces or members 20 and 22, respectively. A plurality of hook surfaces or members 26 engagable with the first snag members 18 are positioned along edge portions of inner surface 12. One possible placement of the components of the first fastening mechanism is illustrated in FIGS. 3 and 4. It will be appreciated that other configurations, lengths and widths of hook and snag surfaces, or members, can be used to provide the desired fastening. The lengths and positioning of the surfaces is determined by the anticipated variations in articles to be carried in the pack belt. If only one type of article is to be carried, one of the strips 20 and 22 could be eliminated. If a wide variation in the size of articles is expected, additional snag members can be positioned parallel to the illustrated members. Alternatively or in addition, the lengths of the members 26 can be increased, as illustrated in FIG. 13.

Figure 14:
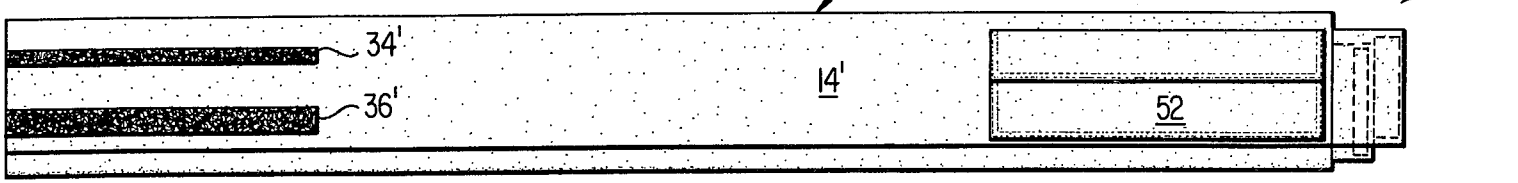
FIG. 14 is a side view of the embodiment illustrated in FIG. 13 in a partially assembled position.

Since the embodiment illustrated in FIGS. 13 and 14 is similar to the embodiment illustrated in FIGS. 1 to 8, the same reference numerals, with primes attached, will be used to identify components similar to those illustrated in FIGS. 1 to 8.

As illustrated in FIGS. 8 and 14, the first complementary fasteners 16 and 16', respectively, provide for releasably securing a carrier member 11 rolled about its longitudinal or horizontal axis (axis A in FIG. 4). If the bulk of the article or articles to be carried is relatively small, hooks 26 are engaged with snags 22 to secure the carrying member in the chain dotted position illustrated in FIG. 8. If numerous or bulky articles are carried, hooks 26 are engaged with snags 20, as illustrated with solid lines in FIG. 8. For the purposes of clarity, the articles encompassed by the rolled carrying member have not been illustrated.

In order to hold the rolled carrying member 11 in a position folded about a vertical axis, generally designated B in FIG. 4, a second set of complementary fasteners, generally designated 28, are connected to carrying member 11. The second complementary fasteners 28 have a plurality of first or snag surfaces or components 32, 34, 36. The snag members extend from one transverse edge of carrying member 11 towards the other. The length of the snag members is determined by anticipated variations in the waist of a user of pack belt 10 and variations in the bulk of materials or articles to be carried. The other transverse edge of carrying member 11 has a plurality of surfaces of hook members, two of which designated 40 and 42 are illustrated. When the pack belt is folded around the waist of a user, as illustrated in FIGS. 1, and 2, hook members 40 and 42 engage one or more of the snag members 30 to releasably secure the pack belt around the waist of a user. When the pack belt 10 has its smallest shape, fasteners 40 and 42 are superimposed on each other when the carrying member is folded about its horizontal axis. When the carrying member is subsequently folded about its vertical axis, hook member 42 engages a portion of snag member 36 close to the edge of carrying member 11, and hook member 40 engages a portion of snag member 36 spaced further from the edge so that the article or articles within the folded and rolled carrying member are subjected to an more than less steady axial force around the outer circumference. Alternatively, with the embodiment illustrated in FIGS. 13 and 14, member 40' is longer than member 42' so that the hook portions of the members are spaced from each other, as illustrated in FIG. 14.

The fasteners employed to secure the carrying member around the axis B are adjustable to compensate for variations in the size of a user's waist, as a minimum, and, at a maximum, variations in both the size of a user's waist and variations in the bulk of articles carried in the pack.

Referring now to FIGS. 5, 6, and 7, it can be seen that the carrying member 11 can be formed of one or more plies of materials. As illustrated in FIG. 5, carrying member 11 is formed of a single ply, such as, heavy duty nylon mesh. FIG. 6 illustrates an embodiment in which the carrying member 11 has an inner surface 12 formed of a moisture absorbent material, such as terrycloth or similar material, and an outer surface 14 formed of a substantially friction-free material, such as chamois. Preferably, the edges of the chamois material are folded over the terrycloth material and secured in a folded condition by sewing, gluing, or other suitable methods. Such a construction provides for a pleasing esthetic appearance of the carrying member. Finally, as illustrated in FIG. 7, the carrying member 11 can be formed of a plurality of plies, for instance, three as illustrated. The innermost ply, if desired, could be limited to a central portion of the carrying member 11, such as region 50 in FIG. 4, to protect carried articles from moisture absorbed by the outer plies.

Referring now to FIG. 14 of the drawings, an embodiment of the present invention is illustrated in which a pocket 52 is connected to outer surface 14' of carrying member 11'. Preferably, pocket 52 is closed by a zipper 53 to securely retain articles, such as keys and money, in the pocket. Also, to enhance the appearance of the pack belt, the zipper is covered by a flap 54 extending from the top of the pocket or connected to outer surface 14'. Preferably, snag and hook fasteners 55 and 56 are provided to releasably secure corners of flap 54.

Considering now the use of the improved pack belt of the present invention, the belt is first unfolded and positioned as illustrated in FIG. 4, with the inner surface facing upwards. Material, such as clothing and the like to be transported is then positioned in a central portion 50, as illustrated by the dot-dash lines in FIG. 4, of the carrying member 11. It will be appreciated that the portion 50 can be larger or smaller than that illustrated i.e. it is determined by the size of the articles within the range of the pack-belt's dimensions. After the articles have been suitably positioned, the carrying member is folded about its horizontal axis or an axis slightly skewed from the horizontal by first positioning the portion of the member carrying snags 20 and 22 over the articles positioned on the carrying member. Subsequently, the portion of the carrying member containing the hooks 26 is folded about the axis A and the hooks 26 are engaged with selected portions of snag components 18. In some cases, depending on the size shape and mass of bulk, the fasteners around the horizontal axis may be superfluous. The steady force around the outer circumference produced by fasteners 28 can, in some instances, be such that snugly securing hooks 26 to snags 22 may not be necessary for the proper functioning of the invention. The configuration of the articles to be carried determines whether or not the axes of hooks 20 are perpendicular or skewed to the axes of snags 18. The rolled tube formed by the engagement between hooks 26 and snags 18 is then positioned about the waist of the user. Hooks 40 and 42 are then engaged with one or more of the snags 30 to releasably hold the folded and rolled carrying member about the waist of the user.

It will be readily appreciated that engagement between snags 18 and hooks 26 subjects articles positioned inside the rolled carrying member 11 to an axial force in one direction. Similarly, engagement between snags 30 and hooks 40 and 42 subjects the articles to a second force that extends generally perpendicular to the first force. Since the carried articles are subjected to two different substantially perpendicular forces, they are securely held in the pack belt in desired positions. There is virtually no movement of the articles. Thus, when the carried articles are relatively bulky, there is little shifting of the articles that might discomfort a wearer of the pack belt.

With the previous embodiments the complementary fasteners have been snag and hook fasteners. This is the preferred mode presently contemplated of practicing the invention. It, however, will be appreciated that other types of complementary fasteners can be used with the present invention. Some suitable complementary fasteners are illustrated in FIGS. 9, 10, 11, and 12.

With the embodiment illustrated in FIG. 9, a carrying strap 60 is connected to the outer side 14 of a carrying member, for instance, by stitching. Alternatively, or in addition, the belt or strap 60 can be passed through one or more loops positioned on carrying member 11. Two rings 62 and 64 are connected to an end 66 of the belt. The other end of the belt is insertable through the rings 62 and 64 to releasably secure a carrying member in a rolled condition.

FIG. 10 illustrates another embodiment of a complementary fastening mechanism suitable for use with the present invention. With this embodiment, a buckle 68 is attached to an end 70 of a belt. The other end 72 of the belt is insertable through the buckle to releasably secure the carrying member (not illustrated) in rolled or folded condition.

Similarly, FIG. 11 illustrates another type of suitable complementary fastening mechanism. The mechanism has a first part 74 of the fastening mechanism connected to an end 76 of a belt, with a second part 78 of the mechanism forming the other end 78 of the belt.

With the embodiments illustrated in FIGS. 9 and 10, a fastening mechanism is used that has a first component positioned on one end of a belt or strap for frictionally engaging and releasably holding the other end of the belt or strap. With the embodiment illustrated in FIG. 11, the fastening mechanism has a first component positioned on one end of a belt or strap that positively engages and releasably holds the other end of the belt or strap. It will be appreciated that the belt can be continuous, as illustrated in FIG. 9, or formed of individual segments connected close to the edges of the carrying member.

FIG. 12 illustrates still another embodiment of a suitable fastening mechanism. With this embodiment, the fastening mechanism is formed by ends 80 and 82 of a belt.

It will be appreciated that the fastening mechanisms illustrated in FIGS. 9, 10, 11, and 12 can be used in addition to or in place of either one or both of the fastening mechanisms 16 and 28. Also, other types of fastening mechanisms can be used as long as they allow adjustable fastening of the pack belt around the waist of a user.

The present invention has been described in detail with particular reference to preferred embodiments thereof, but it will be understood that variations and modifications can be effected within the spirit and scope of the invention.

What is claimed is:

1. A foldable pack belt for carrying at least one article comprising:

a substantially planar member having first and second longitudinally-extending edges interconnected by first and second transversely-extending edges;

first complementary fastening means having a first component associated with said first longitudinally-extending edge and a second component associated with said second longitudinally-extending edge, said first component having a portion thereof selectively releasably engaged by said second component to releasably and adjustably interconnect said first and said second longitudinally-extending edges to each other so that the size of a carrying portion of the pack belt is adjusted whereby a first compressive force is exerted on an article to be carried when longitudinally-extending edges of said planar member are folded about a longitudinally-extending axis and interconnected to each other to encompass the article; and second complementary fastening means having a first component associated with said first transversely-extending edge and a second component associated with said second transversely-extending edge, said first component of said second complementary fastening means having a portion thereof selectively releasably engaged by said second component to adjustably releasably interconnect said first and said second transversely-extending edges to each other so that a second compressive force is exerted on a carried article when said planar member is folded about an axis extending generally perpendicular to the longitudinal axis, the axis being inside and spaced from the folded member.

2. A foldable pack belt according to claim 1, wherein said first complementary fastening means comprises a snag and hook fastener.

3. A foldable pack belt according to claim 1 or 2, wherein said second complementary fastening means comprises a snag and hook fastener.

4. A foldable pack belt according to claim 1, wherein said planar member has an inner surface and an outer surface, and wherein said first complementary fastening means comprises:

a first component comprising a longitudinally-extending snag surface connected to the outer surface of said planar member generally parallel to and closely spaced from said first longitudinally-extending edge, and a second component comprising a plurality of hook surfaces connected to the inner surface of said planar member, said hook surfaces extending from said second longitudinally-extending edge towards said first longitudinally-extending edge, said hook surfaces being engagable with said snag surface after said first longitudinally-extending edge has been folded about the longitudinal axis.

5. A foldable pack belt according to claim 4, wherein said first component comprises a plurality of longitudinally-extending snag surfaces connected to the outer surface of said planar member generally parallel to and spaced from each other and said first longitudinally-extending edge, said hook surfaces being engagable with at least one of said snag surfaces.

6. A foldable pack belt according to claim 5, wherein said second complementary fastening means comprises:

a first component comprising a longitudinally-extending snag surface positioned on the outer surface of said planar member and extending from said first towards said second transverse edge in a direction generally parallel to the longitudinal axis, and a second component comprising a hook surface extending away from the second transverse edge and positioned on the inner surface of said planar member, said hook surface being releasably engagable with said snag surface to interconnect said first and said second transverse edges so that the folded member encompasses the waist of a user of the pack belt.

7. A foldable pack belt according to claim 6, wherein said first component of said second complementary fastening means comprises a plurality of snag surfaces, and wherein said second component of said second complementary fastening means comprises a plurality of hook surfaces extending away from the second transverse edge.

8. A foldable pack belt according to claim 4, wherein the inner surface is comprised of towelling material and the outer surface is comprised of a substantially smooth porous material so that friction between the folded pack belt and a user is minimized.

9. A foldable pack belt according to claim 1, wherein one of said first and said second complementary fastening means comprises pairs of belts having ends forming said first and said second components of the fastening means.

10. A foldable pack belt according to claim 9, wherein at least one of said pairs of belts has a first belt portion and a second belt portion, an end portion of said first belt portion supporting means for frictionally engaging an end portion of said second belt portion.

11. A foldable pack belt according to claim 9, wherein at least one of said pairs of belts has a first belt portion and a second belt portion, an end portion of said first belt portion supporting means for positively engaging an end portion of said second belt portion.

12. A foldable pack belt for carrying at least one article comprising:

a planar member having an inner surface that encompasses at least one article being carried, an outer surface that is foldable about the body of a user of the pack belt, first and second at least partially longitudinally-extending edges, and first and second at least partially transversely-extending edges interconnecting the longitudinally-extending edges;

first complementary fastening means for releasably interconnecting portions of the planar member to each other to subject an article positioned on the inner surface to a first adjustable compressive force, said first complementary fastening means including:

at least one longitudinally-extending snag surface positioned on the outer surface of said planar member closely spaced from and extending generally parallel to the first longitudinally-extending edge; and a plurality of transversely-extending hook surfaces positioned on the inner surface of said planar member and having first ends located closer to said second than said first longitudinally-extending edge, the other ends of said hook surfaces being spaced further from said second longitudinally-extending edge than said first ends, portions of said hook surfaces being releasably engagable with selective portions of said snag surface after said first longitudinally-extending edge has been folded towards said second longitudinally-extending edge, and said second longitudinally-extending edge has been folded over said first longitudinally-extending edge, the region of engagement being adjustable and a function of the bulk of the at least one article to be carried so that an adjustable compressive force is exerted on the article; and second complementary fastening means for releasably interconnecting portions of the planar member to each other to subject an article positioned on the inner surface to a second compressive force, said second complementary means including:

at least one longitudinally-extending snag surface positioned on the exterior surface of said planar member and extending from said first towards said second transversely-extending edge and having an end closely spaced from said first transversely-extending edge, and at least one hook surface positioned on the exterior surface of said planar member adjacent to said second transversely-extending edge, said hook surface being engagable with a selected portion of said snag surface of said second complementary fastening means to exert an adjustable compressive force on the article when the pack belt is releasably secured about the waist of a user, the engaged portion of said snag surface being a function of the bulk of the at least one article carried.

13. A foldable pack belt according to claim 12, wherein said first complementary fastening means comprises a plurality of spaced apart longitudinally-extending snag surfaces.

14. A foldable pack belt according to claim 12 or 13, wherein said second complementary fastening means comprises a plurality of hook and snag surfaces.

15. A foldable pack belt according to claim 14, wherein said hook surfaces of said second complementary fastening means protrude from said second transversely-extending edge.

16. A foldable pack belt according to claim 15, wherein one of said plurality of hook surfaces of said second complementary fastening means protrudes further from said edge than another of said surfaces so that portions of said surfaces are spaced from each other when said second longitudinally-extending edge is folded over said first longitudinally-extending edge.

17. A foldable pack belt according to claim 12, wherein said pack belt further comprises a pocket connected to the outer surface of said planar member for carrying at least one relatively small article.

18. An article foldable to form a pack for carrying at least one item, said article comprising:

a substantially planar member having first and second longitudinally-extending edges;

first complementary fastening means having first and second components thereof attached to said planar member in such manner that said components are engageable with each other after said first longitudinally-extending edge has been folded towards said second longitudinally-extending edge and said second longitudinally-extending edge has been folded over said first longitudinally-extending edge, whereby engagement between said components releasably holds said planar member in a folded condition defining a rolled tube for encompassing an item to be carried; and second complementary fastening means having first and second components thereof attached to said planar member in such manner that said components are engageable with each other after said first and second transversely-extending edges have been folded towards each other to thereby releasably interconnect said edges to each other, folding of said transversely-extending edges towards each other and engagement of said second complementary fastening means, after folding of said longitudinally-extending edges and engagement of said first complementary fastening means to define said rolled tube, forming a pack from said planar member.

19. An article according to claim 18, wherein said first component of said first complementary fastening means comprises a plurality of elements spaced along said first longitudinally-extending edge, and wherein said second component of said first complementary fastening means comprises a plurality of elements correspondingly spaced along said second longitudinally-extending edge.

20. An article according to claim 19, wherein said first component of said second complementary fastening means comprises a plurality of elements spaced along said first transversely-extending edge, and wherein said second component of said second complementary fastening means comprises a plurality of elements correspondingly spaced along said second transversely-extending edge.

21. An article according to claim 20, wherein said first and said second complementary fastening means comprise snag and hook fasteners.

* * * * *